US009082398B2

(12) United States Patent
Gao

(10) Patent No.: US 9,082,398 B2
(45) Date of Patent: Jul. 14, 2015

(54) SYSTEM AND METHOD FOR POST EXCITATION ENHANCEMENT FOR LOW BIT RATE SPEECH CODING

(71) Applicant: Huawei Technologies Co., Ltd., Shenzhen (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 263 days.

(21) Appl. No.: 13/779,589

(22) Filed: Feb. 27, 2013

(65) Prior Publication Data

US 2013/0246055 A1 Sep. 19, 2013

Related U.S. Application Data

(60) Provisional application No. 61/604,164, filed on Feb. 28, 2012.

(51) Int. Cl.

| | |
|---|---|
| ***G10L 19/04*** | (2013.01) |
| ***G10L 21/00*** | (2013.01) |
| ***G10L 19/12*** | (2013.01) |
| ***G10L 19/26*** | (2013.01) |

(52) U.S. Cl.

CPC ..... *G10L 19/04* (2013.01); *G10L 19/12* (2013.01); *G10L 19/26* (2013.01)

(58) Field of Classification Search

CPC ... G10L 19/12; G10L 21/038; G10L 19/0212; G10L 19/005; G10L 19/03

USPC ..... 704/205, 223, 500, 219, 220, 225, 226, 704/228

See application file for complete search history.

(56) References Cited

U.S. PATENT DOCUMENTS

| | | | | |
|---|---|---|---|---|
| 6,466,904 | B1 | 10/2002 | Gao et al. | |
| 6,910,009 | B1 | 6/2005 | Murashima | |
| 8,260,611 | B2 * | 9/2012 | Vos et al. | 704/223 |
| 8,725,501 | B2 * | 5/2014 | Ehara | 704/226 |
| 2002/0052738 | A1 | 5/2002 | Paksoy et al. | |
| 2010/0063802 | A1 | 3/2010 | Gao | |
| 2014/0257827 | A1 * | 9/2014 | Norvell et al. | 704/500 |

OTHER PUBLICATIONS

"Notification of Transmittal of the International Search Report and the Written Opinion of the International Searching Authority, or the Declaration," International Application Serial No. PCT/CN2013/080254, mailing date Dec. 12, 2013, 10 pages.

* cited by examiner

*Primary Examiner* — Charlotte M Baker
(74) *Attorney, Agent, or Firm* — Slater & Matsil, L.L.P.

(57) ABSTRACT

In accordance with an embodiment, a method of decoding an audio/speech signal includes decoding an excitation signal based on an incoming audio/speech information, determining a stability of a high frequency portion of the excitation signal, smoothing an energy of the high frequency portion of the excitation signal based on the stability of the high frequency portion of the excitation signal, and producing an audio signal based on smoothing the high frequency portion of the excitation signal.

29 Claims, 11 Drawing Sheets

SYSTEM AND METHOD FOR POST EXCITATION ENHANCEMENT FOR LOW BIT RATE SPEECH CODING

This patent application claims priority to U.S. Provisional Application No. 61/604,164 filed on Feb. 28, 2012, entitled "Post Excitation Enhancement for Low Bit Rate Speech Coding," which application is hereby incorporated by reference herein in its entirety.

TECHNICAL FIELD

The present invention is generally in the field of signal coding. In particular, the present invention is in the field of low bit rate speech coding.

BACKGROUND

Traditionally, all parametric speech coding methods make use of the redundancy inherent in the speech signal to reduce the amount of information that must be sent and to estimate the parameters of speech samples of a signal at short intervals. This redundancy primarily arises from the repetition of speech wave shapes at a quasi-periodic rate, and the slow changing spectral envelop of speech signal.

The redundancy of speech waveforms may be considered with respect to several different types of speech signals, such as voiced and unvoiced. For voiced speech, the speech signal is essentially periodic; however, this periodicity may be variable over the duration of a speech segment and the shape of the periodic wave usually changes gradually from segment to segment. A low bit rate speech coding could greatly benefit from exploring such periodicity. The voiced speech period is also called pitch, and pitch prediction is often named Long-Term Prediction (LTP). As for unvoiced speech, the signal is more like a random noise and has a smaller amount of predictability.

In either case, parametric coding may be used to reduce the redundancy of the speech segments by separating the excitation component of speech signal from the spectral envelope component. The slowly changing spectral envelope can be represented by Linear Prediction Coding (LPC), also known as Short-Term Prediction (STP). A low bit rate speech coding could also benefit from exploring such a Short-Term Prediction. The coding advantage arises from the slow rate at which the parameters change. Yet, it is rare for the parameters to be significantly different from the values held within a few milliseconds. Accordingly, at the sampling rate of 8 kHz, 12.8 kHz or 16 kHz, the speech coding algorithm is such that the nominal frame duration is in the range of ten to thirty milliseconds, where a frame duration of twenty milliseconds is most common. In more recent well-known standards such as G.723.1, G.729, G.718, EFR, SMV, AMR, VMR-WB or AMR-WB, the Code Excited Linear Prediction Technique ("CELP") has been adopted, which is commonly understood as a technical combination of Coded Excitation, Long-Term Prediction and Short-Term Prediction. Code-Excited Linear Prediction (CELP) Speech Coding is a very popular algorithm principle in speech compression area although the details of CELP for different CODECs differ significantly.

FIG. 1 illustrates a conventional CELP encoder where weighted error 109 between synthesized speech 102 and original speech 101 is minimized often by using a so-called analysis-by-synthesis approach. W(z) is an error weighting filter 110, 1/B(z) is a long-term linear prediction filter 105, and 1/A(z) is a short-term linear prediction filter 103. The coded excitation 108, which is also called fixed codebook excitation, is scaled by gain $G_c$ 106 before going through the linear filters. The short-term linear filter 103 is obtained by analyzing the original signal 101 and represented by a set of coefficients:

$$A(z) = \sum_{i=1}^{P} 1 + a_i \cdot z^{-i},\ i = 1, 2, \ldots, P. \tag{1}$$

The weighting filter 110 is somehow related to the above short-term prediction filter. A typical form of the weighting filter is:

$$W(z) = \frac{A(z/\alpha)}{A(z/\beta)}, \tag{2}$$

where $\beta<\alpha$, $0<\beta<1$, $0<\alpha\leq 1$. The long-term prediction 105 depends on pitch and pitch gain. A pitch may be estimated, for example, from the original signal, residual signal, or weighted original signal. The long-term prediction function in principal may be expressed as $$B(z)=1-\beta\cdot z^{-Pitch}. \tag{3}$$

The coded excitation 108 normally comprises a pulse-like signal or noise-like signal, which are mathematically constructed or saved in a codebook. Finally, the coded excitation index, quantized gain index, quantized long-term prediction parameter index, and quantized short-term prediction parameter index are transmitted to the decoder.

FIG. 2 illustrates an initial decoder that adds a post-processing block 207 after synthesized speech 206. The decoder is a combination of several blocks that are coded excitation 201, excitation gain 202, long-term prediction 203, short-term prediction 205 and post-processing 207. Every block except post-processing block 207 has the same definition as described in the encoder of FIG. 1. Post-processing block 207 may also include short-term post-processing and long-term post-processing.

FIG. 3 shows a basic CELP encoder that realizes the long-term linear prediction by using adaptive codebook 307 containing a past synthesized excitation 304 or repeating past excitation pitch cycle at pitch period. Pitch lag may be encoded in integer value when it is large or long and pitch lag is may be encoded in more precise fractional value when it is small or short. The periodic information of pitch is employed to generate the adaptive component of the excitation. This excitation component is then scaled by gain $G_p$ 305 (also called pitch gain). The second excitation component is generated by coded-excitation block 308, which is scaled by gain $G_c$ 306. Gc is also referred to as fixed codebook gain, since the coded-excitation often comes from a fixed codebook. The two scaled excitation components are added together before going through the short-term linear prediction filter 303. The two gains ($G_p$ and $G_c$) are quantized and then sent to a decoder.

FIG. 4 illustrates a conventional decoder corresponding to the encoder in FIG. 3, which adds a post-processing block 408 after a synthesized speech 407. This decoder is similar to FIG. 2 with the addition of adaptive codebook 307. The decoder is a combination of several blocks, which are coded excitation 402, adaptive codebook 401, short-term prediction 406, and post-processing 408. Every block except post-processing block 408 has the same definition as described in the encoder of FIG. 3. Post-processing block 408 may further include short-term post-processing and long-term post-processing.

Long-Term Prediction plays very important role for voiced speech coding because voiced speech has a strong periodicity. The adjacent pitch cycles of voiced speech are similar each other, which means mathematically that pitch gain $G_p$ in the following excitation expression is high or close to 1, $$e(n)=G_p \cdot e_p(n)+G_c \cdot e_c(n), \quad (4)$$

where $e_p(n)$ is one subframe of sample series indexed by n, coming from the adaptive codebook 307 which comprises the past excitation 304; $e_p(n)$ may be adaptively low-pass filtered as low frequency area is often more periodic or more harmonic than high frequency area; $e_c(n)$ is from the coded excitation codebook 308 (also called fixed codebook) which is a current excitation contribution; and $e_c(n)$ may also be enhanced using high pass filtering enhancement, pitch enhancement, dispersion enhancement, formant enhancement, and the like. For voiced speech, the contribution of $e_p(n)$ from the adaptive codebook may be dominant and the pitch gain $G_p$ 305 may be a value of about 1. The excitation is usually updated for each subframe. A typical frame size is 20 milliseconds and typical subframe size is 5 milliseconds.

SUMMARY OF THE INVENTION

In accordance with an embodiment, a method of decoding an audio/speech signal includes decoding an excitation signal based on an incoming audio/speech information, determining a stability of a high frequency portion of the excitation signal, smoothing an energy of the high frequency portion of the excitation signal based on the stability of the high frequency portion of the excitation signal, and producing an audio signal based on smoothing the high frequency portion of the excitation signal.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in different figures generally refer to corresponding parts unless otherwise indicated. The figures are drawn to clearly illustrate the relevant aspects of the preferred embodiments and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to embodiments in a specific context, namely a CELP-based audio encoder and decoder. It should be understood that embodiments of the present invention may be directed toward other systems.

As already mentioned, CELP is mainly used to encode speech signal by benefiting from specific human voice characteristics or human vocal voice production model. CELP algorithm is a very popular technology that has been used in various ITU-T, MPEG, 3GPP, and 3GPP2 standards. In order to encode speech signal more efficiently, a speech signal may be classified into different classes and each class is encoded in a different way. For example, in some standards such as G.718, VMR-WB or AMR-WB, a speech signal is classified into UNVOICED, TRANSITION, GENERIC, VOICED, and NOISE. For each class, a LPC or STP filter is always used to represent spectral envelope; but the excitation to the LPC filter may be different. UNVOICED and NOISE may be coded with a noise excitation and some excitation enhancement. TRANSITION may be coded with a pulse excitation and some excitation enhancement without using adaptive codebook or LTP. GENERIC may be coded with a traditional CELP approach such as Algebraic CELP used in G.729 or AMR-WB, in which one 20 ms frame contains four 5 ms subframes, both the adaptive codebook excitation component and the fixed codebook excitation component are produced with some excitation enhancements for each subframe, pitch lags for the adaptive codebook in the first and third subframes are coded in a full range from a minimum pitch limit PIT_MIN to a maximum pitch limit PIT_MAX, and pitch lags for the adaptive codebook in the second and fourth subframes are coded differentially from the previous coded pitch lag. A VOICED class signal may be coded slightly differently from GNERIC, in which pitch lag in the first subframe is coded in a full range from a minimum pitch limit PIT_MIN to a maximum pitch limit PIT_MAX, and pitch lags in the other subframes are coded differentially from the previous coded pitch lag.

Figure 1:
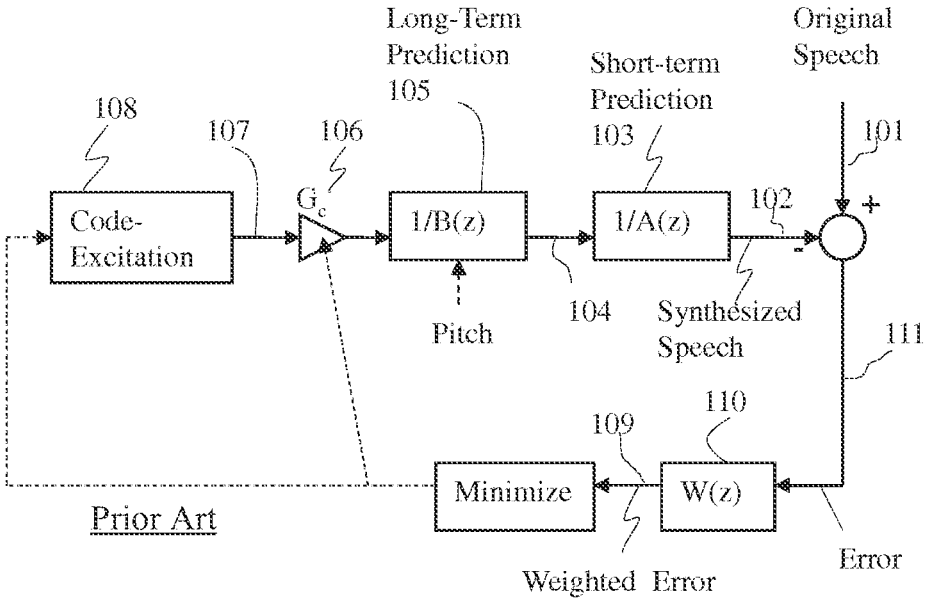
FIG. 1 illustrates a conventional CELP speech encoder.
Figure 2:
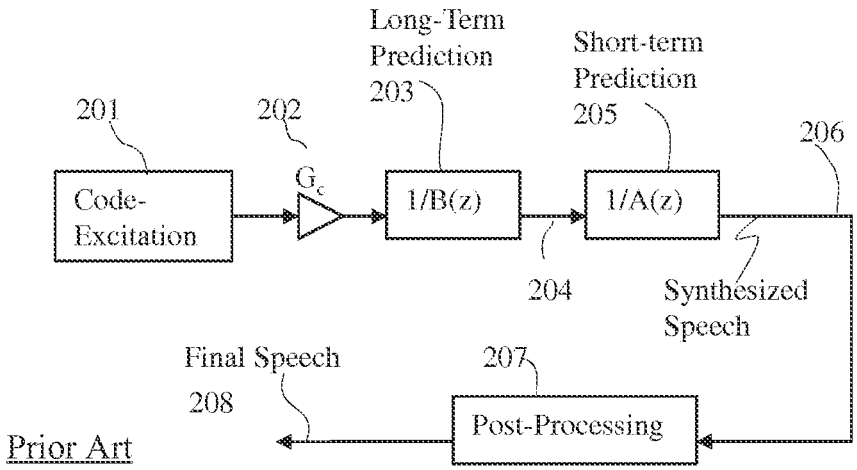
FIG. 2 illustrates a conventional CELP speech decoder.
Figure 3:
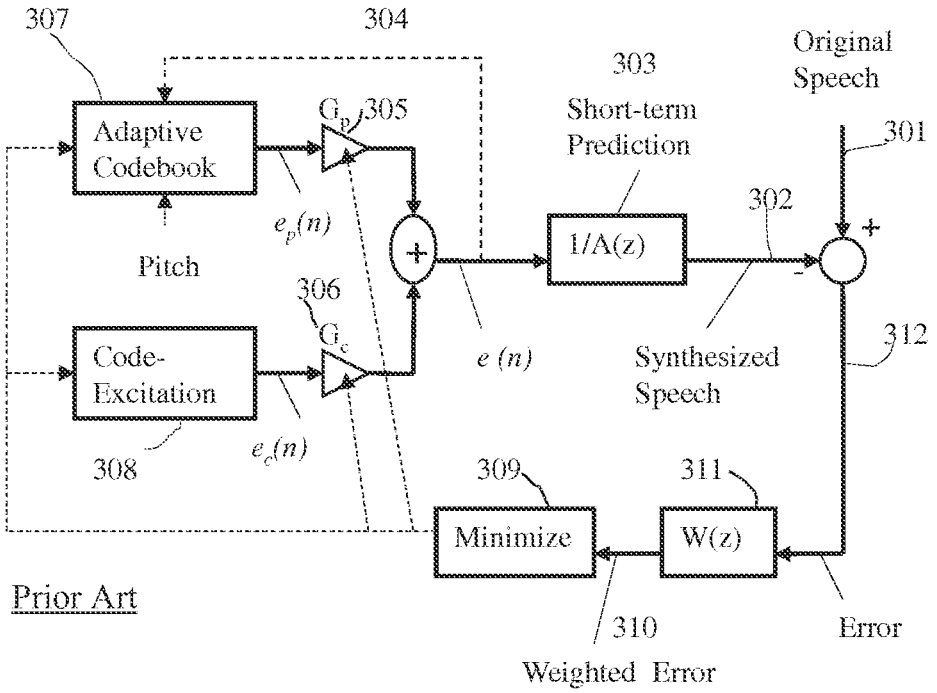
FIG. 3 illustrates a conventional CELP encoder that utilizes an adaptive codebook.
Figure 4:
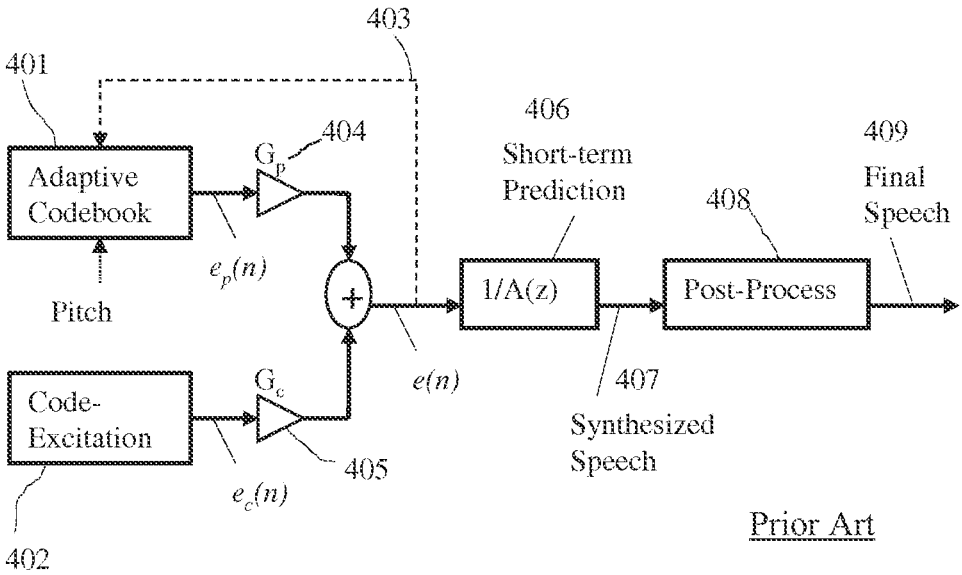
FIG. 4 illustrates a conventional CELP speech decoder that utilizes an adaptive codebook.
Figure 5:
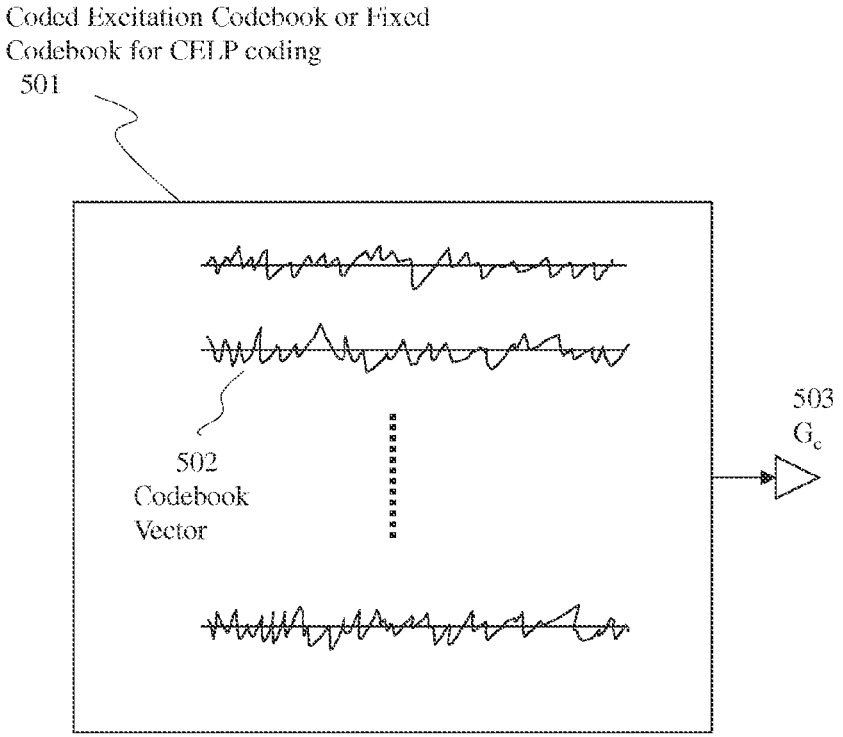
FIG. 5 illustrates a FCB structure that contains noise-like candidate vectors for constructing a coded excitation.
Figure 6:
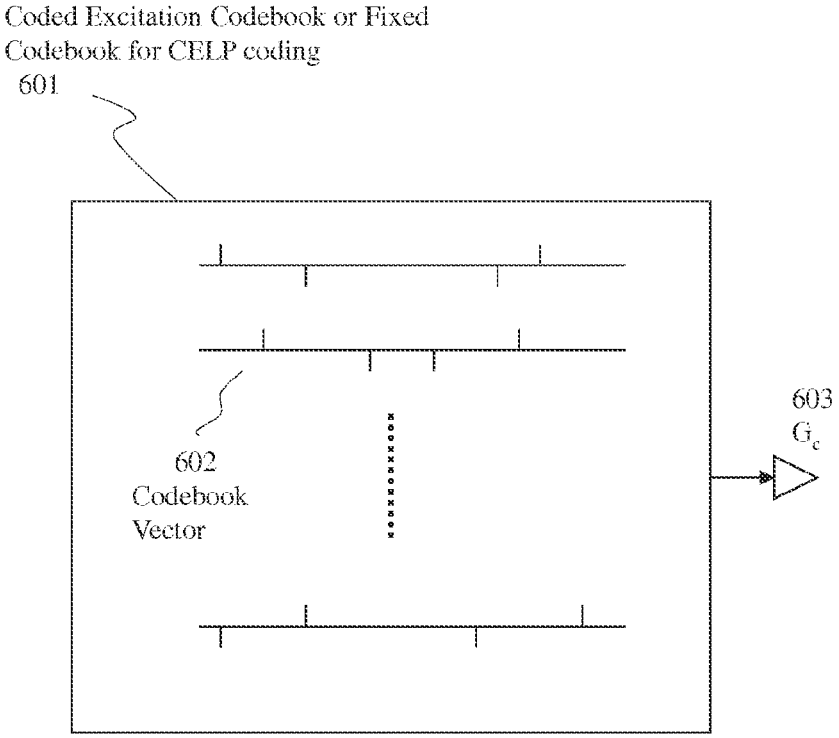
FIG. 6 illustrates a FCB structure that contains pulse-like candidate vectors for constructing a coded excitation.

Code-Excitation block 402 in FIG. 4 and 308 in FIG. 3 show the location of Fixed Codebook (FCB) for a general CELP coding; a selected code vector from FCB is scaled by a gain often noted as $G_c$. For NOISE or UNVOICED class signal, an FCB containing noise-like vectors may be the best structure from perceptual quality point of view, because the adaptive codebook contribution or LTP contribution would be small or non-existant, and because the main excitation contribution relies on the FCB component for NOISE or UNVOICED class signal. In this case, if a pulse-like FCB such as that shown in FIG. 6 is used, the output synthesized speech signal could sound spiky due to the many zeros found in the code vector selected from a pulse-like FCB designed for low bit rate coding. FIG. 5 illustrates a FCB structure that contains noise-like candidate vectors for constructing a coded excitation. 501 is a noise-like FCB; 502 is a noise-like code vector; and a selected code vector is scaled by a gain 503.

For a VOICED class signal, a pulse-like FCB yields a higher quality output than a noise-like FCB from perceptual point of view, because the adaptive codebook contribution or LTP contribution is dominant for the highly periodic VOICED class signal and the main excitation contribution does not rely on the FCB component for the VOICED class signal. In this case, if a noise-like FCB is used, the output synthesized speech signal may sound noisy or less periodic, since it is more difficult to have good waveform matching between the synthesized signal and the original signal by using the code vector selected from the noise-like FCB designed for low bit rate coding. FIG. 6 illustrates a FCB structure that contains pulse-like candidate vectors for constructing a coded excitation. 601 represents a pulse-like FCB, and 602 represents a pulse-like code vector. A selected code vector is scaled by a gain 603.

Most CELP codecs work well for normal speech signals; however low bit rate CELP codecs could fail in the presence of an especially noisy speech signal or for a GENERIC class signal. As already described, a noise-like FCB may be the best choice for NOISE or UNVOICED class signal and a pulse-like FCB may be the best choice for VOICED class signal. The GENERIC class is between VOICED class and UNVOICED class. Statistically, LTP gain or pitch gain for GENERIC class may be lower than VOICED class but higher than UNVOICED class. The GENERIC class may contain both a noise-like component signal and periodic component signal. At low bit rates, if a pulse-like FCB is used for GENERIC class signal, the output synthesized speech signal may still sound spiky since there are a lot of zeros in the code vector selected from the pulse-like FCB designed for low bit rate coding. For example, when an 6800 bps or 7600 bps codec encodes a speech signal sampled at 12.8 kHz, a code vector from the pulse-like codebook may only afford to have two non-zero pulses, thereby causing a spiky sound for noisy speech. If a noise-like FCB is used for GENERIC class signal, the output synthesized speech signal may not have a good enough waveform matching to generate a periodic component, thereby causing noisy sound for clean speech. Therefore, a new FCB structure between noise-like and pulse-like may be needed for GENERIC class coding at low bit rates.

Figure 7:
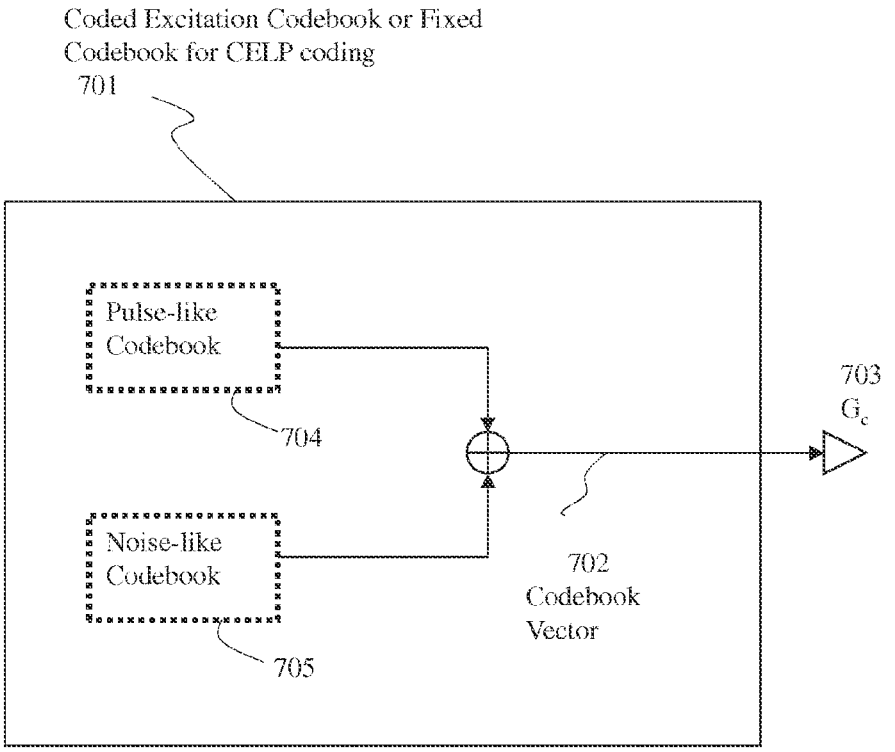
FIG. 7 illustrates an embodiment structure of a pulse-noise mixed FCB.

One of the solutions for having better low-bit rates speech coding for GENERIC class signal is to use a pulse-noise mixed FCB instead of a pulse-like FCB or a noise-like FCB. FIG. 7 illustrates an embodiment structure of the pulse-noise mixed FCB. 701 indicates the whole pulse-noise mixed FCB. The selected code vector 702 is generated by combining (adding) a vector from a pulse-like sub-codebook 704 and a vector from a noise-like sub-codebook 705. The selected code vector 702 is then scaled by the FCB gain $G_c$ 703. For example, 6 bits are assigned to the pulse-like sub-codebook 704, in which 5 bits are to code one pulse position and 1 bit is to code a sign of the pulse-like vectors; 6 bits are assigned to the noise-like sub-codebook 705, in which 5 bits are to code 32 different noise-like vectors and 1 bit is to code a sign of the noise-like vectors.

Figure 8:
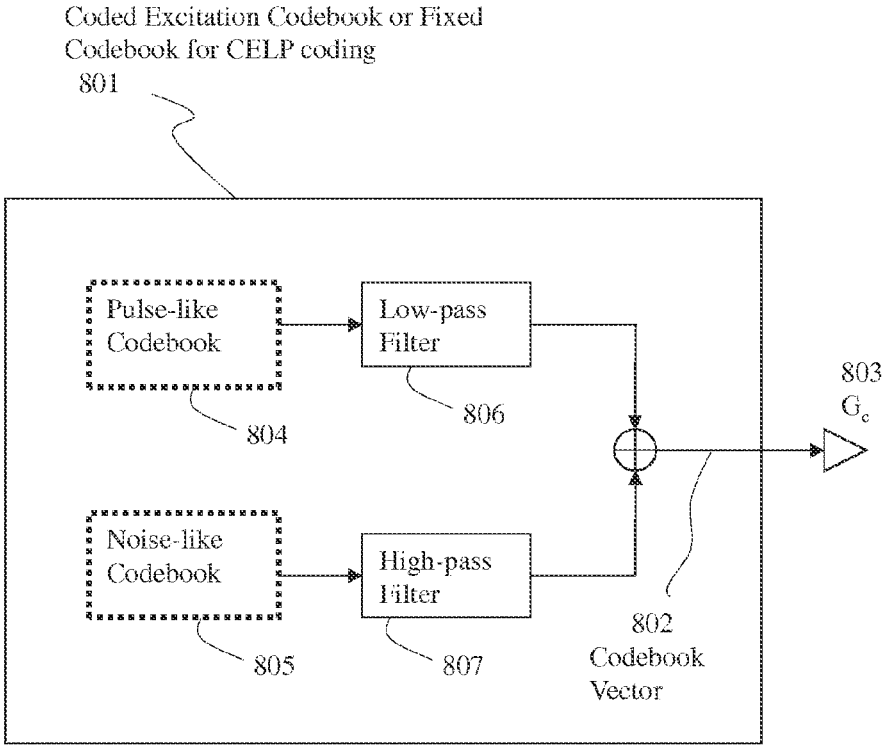
FIG. 8 illustrates an embodiment structure of a pulse-noise mixed FCB.

FIG. 8 illustrates an embodiment structure of a pulse-noise mixed FCB 801. As a code vector from a pulse-noise mixed FCB is a combination of a vector from a pulse-like sub-codebook and a vector from a noise-like sub-codebook, different enhancements may be applied respectively to the vector from the pulse-like sub-codebook and the vector from the noise-like sub-codebook. For example, a low pass filter can be applied to the vector from the pulse-like sub-codebook; this is because low frequency area is often more periodic than high frequency area and low frequency area needs more pulse-like excitation than high frequency area; a high pass filter can be applied to the vector from the noise-like sub-codebook; this is because high frequency area is often more noisy than low frequency area and high frequency area needs more noise-like excitation than low frequency area. Selected code vector 802 is generated by combining (adding) a low-pass filtered vector from a pulse-like sub-codebook 804 and a high-pass filtered vector from a noise-like sub-codebook 805. 806 indicates the low-pass filter that may be fixed or adaptive. For example, a first-order filter $(1+0.4Z^{-1})$ is used for a GENERIC speech frame close to voiced speech signal and one-order filter $(1+0.3Z^{-1})$ is used for a GENERIC speech frame close to unvoiced speech signal. 807 indicates the high-pass filter which can be fixed or adaptive; for example, first-order filter $(1-0.4Z^{-1})$ is used for a GENERIC speech frame close to unvoiced speech signal and first-order filter $(1-0.3Z^{-1})$ is used for a GENERIC speech frame close to voiced speech signal. Enhancement filters 806 and 807 normally do not spend bits to code the filter coefficients, and the coefficients of the enhancement filters may be adaptive to available parameters in both encoder and decoder. The selected code vector 802 is then scaled by the FCB gain $G_c$ 803. As the example given for FIG. 8, if 12 bits are available to code the pulse-noise mixed FCB, in FIG. 8, 6 bits can be assigned to the pulse-like sub-codebook 804, in which 5 bits are to code one pulse position and 1 bit is to code a sign of the pulse-like vectors. For example, 6 bits can be assigned to the noise-like sub-codebook 805, in which 5 bits are to code 32 different noise-like vectors and 1 bit is to code a sign of the noise-like vectors.

Figure 9:
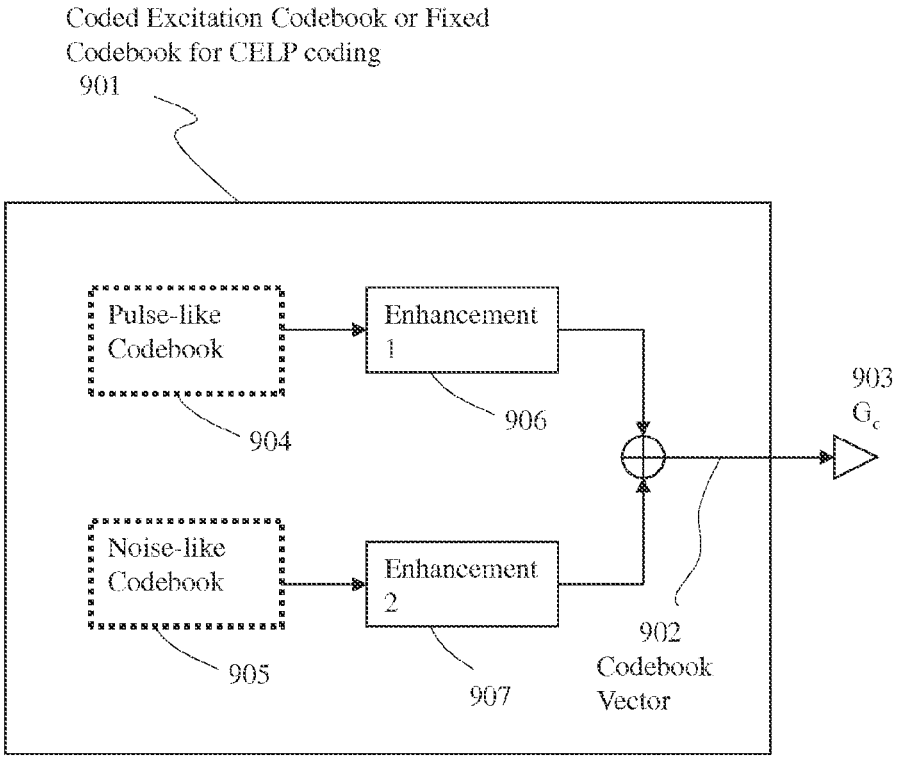
FIG. 9 illustrates a general structure of an embodiment pulse-noise mixed FCB.

FIG. 9 illustrates a more general structure of an embodiment pulse-noise mixed FCB 901. As a code vector from the pulse-noise mixed FCB in FIG. 9 is a combination of a vector from a pulse-like sub-codebook and a vector from a noise-like sub-codebook, different enhancements may be applied respectively to the vector from the pulse-like sub-codebook and the vector from the noise-like sub-codebook. For example, an enhancement including low pass filter, high-pass filter, pitch filter, and/or formant filter can be applied to the vector from the pulse-like sub-codebook; similarly, an enhancement including low pass filter, high-pass filter, pitch filter, and/or formant filter can be applied to the vector from the noise-like sub-codebook. Selected code vector 902 is generated by combining (adding) an enhanced vector from a pulse-like sub-codebook 904 and an enhanced vector from a noise-like sub-codebook 905. 906 indicates the enhancement for the pulse-like vectors, which can be fixed or adaptive. 907 indicates the enhancement for the noise-like vectors, which can also be fixed or adaptive. The enhancements 906 and 907 normally do not spend bits to code the enhancement parameters. The parameters of the enhancements can be adaptive to available parameters in both encoder and decoder. The selected code vector 902 is then scaled by the FCB gain $G_c$ 903. As the example given for FIG. 9, if 12 bits are available to code the pulse-noise mixed FCB in FIG. 9, 6 bits can be assigned to the pulse-like sub-codebook 904, in which 5 bits are to code one pulse position and 1 bit is to code a sign of the pulse-like vectors; and 6 bits can be assigned to the noise-like sub-codebook 905, in which 5 bits are to code 32 different noise-like vectors and 1 bit is to code a sign of the noise-like vectors.

Figure 10:
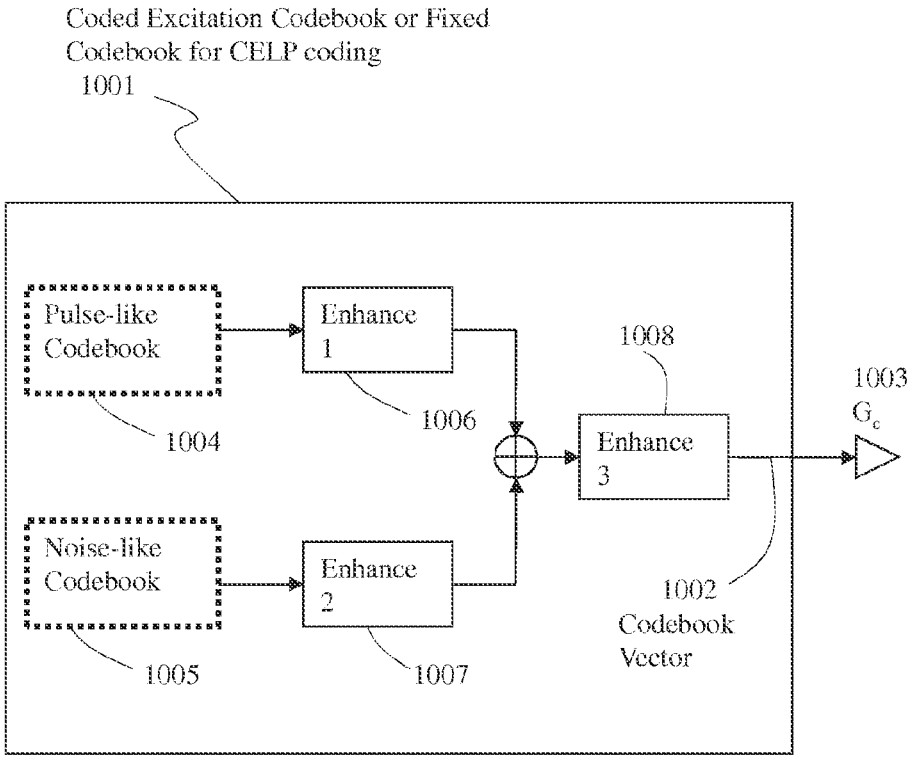
FIG. 10 illustrates a further general structure of an embodiment pulse-noise mixed FCB.

FIG. 10 illustrates a further general structure of an embodiment pulse-noise mixed FCB. As a code vector from the pulse-noise mixed FCB in FIG. 10 is a combination of a vector from a pulse-like sub-codebook and a vector from a noise-like sub-codebook, different enhancements can be applied respectively to the vector from the pulse-like sub-codebook and the vector from the noise-like sub-codebook. For example, a first enhancement including low pass filter, high-pass filter, pitch filter, and/or formant filter can be applied to the vector from the pulse-like sub-codebook; similarly, a second enhancement including low pass filter, high-pass filter, pitch filter, and/or formant filter can be applied to the vector from the noise-like sub-codebook. 1001 indicates the whole pulse-noise mixed FCB. The selected code vector 1002 is generated by combining (adding) a first enhanced vector from a pulse-like sub-codebook 1004 and a second enhanced vector from a noise-like sub-codebook 1005. 1006 indicates the first enhancement for the pulse-like vectors, which can be fixed or adaptive. 1007 indicates the second enhancement for the noise-like vectors, which can also be fixed or adaptive. 1008 indicates the third enhancement for the pulse-noise combined vectors, which can also be fixed or adaptive. The enhancements 1006, 1007, and 1008 normally do not spend bits to code the enhancement parameters; as the parameters of the enhancements can be adaptive to available parameters in both encoder and decoder. The selected code vector 1002 is then scaled by the FCB gain $G_c$ 1003. As the example given for FIG. 10, if 12 bits are available to code the pulse-noise mixed FCB in FIG. 10, 6 bits can be assigned to the pulse-like sub-codebook 1004, in which 5 bits are to code one pulse position and 1 bit is to code a sign of the pulse-like vectors; 6 bits can be assigned to the noise-like sub-codebook 1005, in which 5 bits are to code 32 different noise-like vectors and 1 bit is to code a sign of the noise-like vectors. If the FCB gain $G_c$ is signed, only one of the sign for the pulse-like vectors and the sign for the noise-like vectors needs to be coded.

As described above, for UNVOICED or NOISE class signals, the best excitation type may be noise-like and for VOICED class signals, the best excitation type may be pulse-like. For GENERIC or TRANSITION class signals, the best excitation type may be a mixed pulse-like/noise-like. Although it may be helpful to employ different types of excitation for different signal classes, the waveform matching between the synthesized signal and the original signal may still not good enough at low bit rates, especially for noisy speech signal, unvoiced signal or background noise in some embodiments. This is because the LTP contribution or the pitch gain of the adaptive codebook excitation component is normally small or weak for noise-like input signals. Rough waveform matching may cause energy fluctuation of the synthesized speech signal. This energy fluctuation mainly comes from the synthesized excitation, as LPC filter coefficients are usually quantized with enough bits in an open-loop way that does not cause energy fluctuation. However, when the waveform matching is better, the synthesized or quantized excitation energy is closer to the original or unquantized excitation energy (i.e., ideal excitation energy). On the other hand, when the waveform matching is worse, the synthesized or quantized excitation energy is lower than the original or unquantized excitation energy because worse waveform matching causes lower excitation gains calculated in a closed-loop manner.

Waveform matching is usually much better in low frequency bands than in high frequency bands for two reasons. First, the perceptual weighting filter is designed in such way that a greater coding effort in the low frequency band for most voiced or most background noise signals. Second, waveform matching is easier in the time domain for slowly changing low band signals than for quickly changing high band signals. Therefore, the energy fluctuation of the synthesized high band signal is much larger than the energy fluctuation of the synthesized low band signal. Consequently, the synthesized high band excitation signal has more energy loss than the synthesized low band excitation signal.

Figure 11:
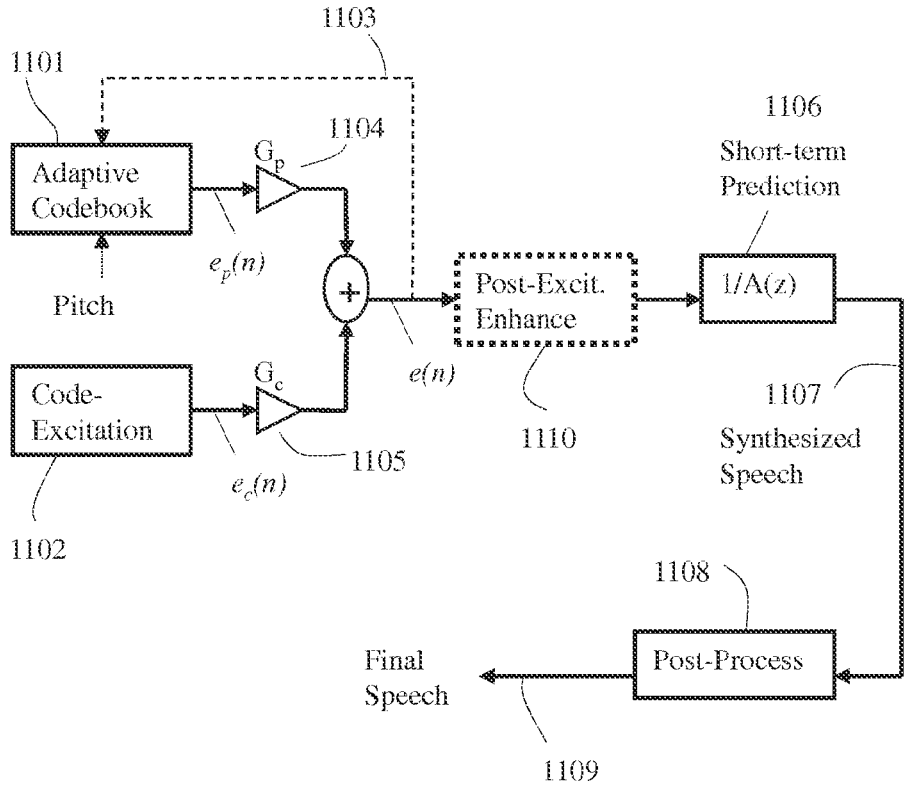
FIG. 11 illustrates an embodiment system for providing post excitation enhancement for a CELP speech decoder.

In situations where the speech coding bit rate is not high enough to achieve good waveform matching, the perceptual quality of noisy speech signal or stable background noise may be efficiently improved by adding a post excitation enhancement on the synthesized excitation. In some embodiments, this may be achieved without spending any extra bits. For example, FIG. 11 illustrates a normal location 1110 to perform post excitation enhancement for a CELP coder. In FIG. 11, 1108 is a traditional post-processing block that operates on synthesized speech signal 1107 in order to enhance spectral formants and/or voiced speech periodicity. This decoder is similar to the decoder of FIG. 4 except that post excitation enhancement block 1110 is added. The decoder may be implemented using combination of several blocks including coded excitation block 1102, adaptive codebook 1101, short-term prediction block 1106 and post-processing block 1108. Each block except the post-processing blocks are similar to those described with respect to the encoder of FIG. 3.

In an embodiment, signal $e_p(n)$ is one subframe of sample series indexed by n emanating from the adaptive codebook 1101 that includes comprises the past excitation 1103. Signal $e_p(n)$ may be adaptively low-pass filtered, since the low frequency regions are often more periodic or more harmonic than high frequency regions. Signal $e_c(n)$ comes from coded excitation codebook 1102 (also called fixed codebook) which is a current excitation contribution. Gain block 1104 is the pitch gain $G_p$ applied to the output of adaptive codebook 1101, and 1105 is the fixed codebook gain $G_c$ applied to the output of code-excitation block 1102.

Figure 12:
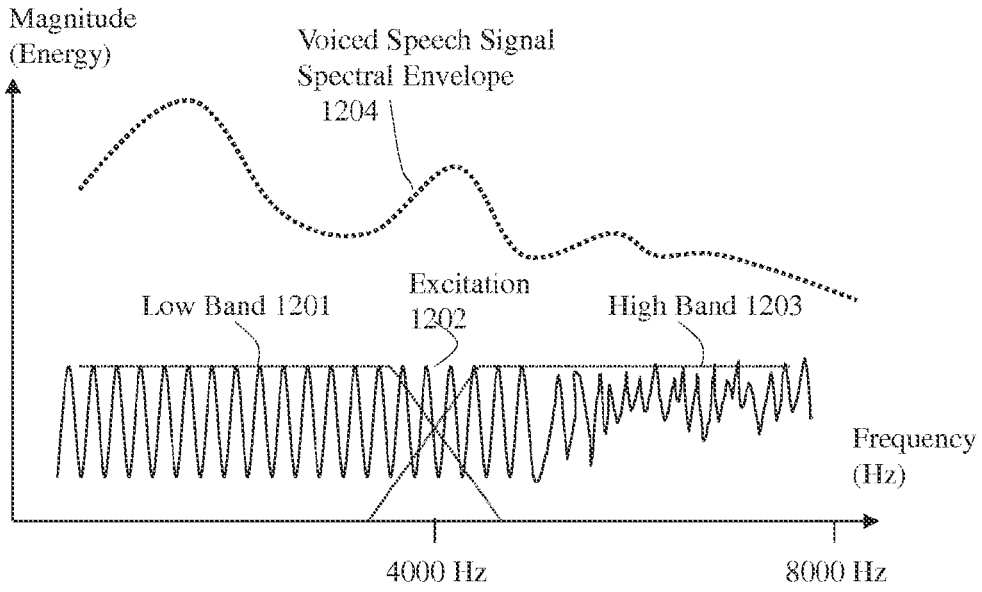
FIG. 12 illustrates an excitation spectrum for voiced speech.

FIG. 12 illustrates an example excitation spectrum for voiced speech. Trace 1202 is the excitation spectrum that appears almost flat after removing LPC spectral envelope 1204. Trace 1201 is a low band excitation spectrum that is usually has a higher harmonic content than high band spectrum 1203 in some embodiments. Theoretically, the ideal or unquantized high band spectrum may have almost the same energy level as the low band excitation spectrum. In practice, however, the synthesized or quantized high band spectrum may have a significantly lower energy level than the synthesized or quantized low band spectrum for two reasons. First, closed-loop CELP coding places a higher emphasis on the low band than on the high band. Second, waveform matching for the low band signal is easier to implement that waveform matching for the high band signal. This is not only due to the faster changing of the high band signal, but also due to the more noise-like characteristics of the high band signal. In many embodiments, the synthesized or quantized high band spectrum has a higher fluctuation of its energy level over time than the synthesized or quantized low band spectrum depending on the quality of the applied waveform matching.

Figure 13:
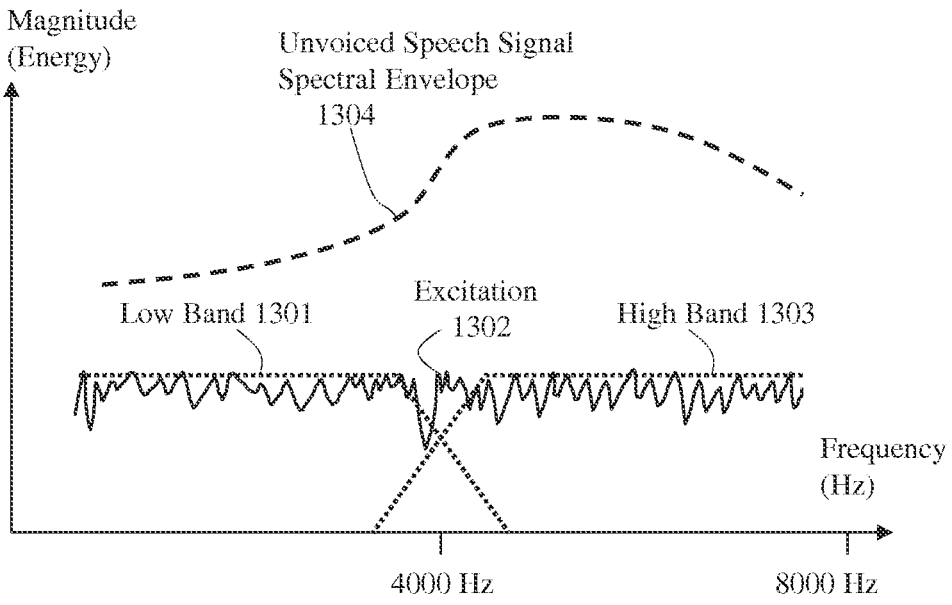
FIG. 13 illustrates an excitation spectrum for unvoiced speech.

FIG. 13 illustrates an example excitation spectrum for unvoiced speech. Trace 1302 represents an excitation spectrum that is almost flat after removing the LPC spectral envelope 1304. Trace 1301 is a low band excitation spectrum that is also noise-like as high band spectrum 1303. Theoretically, an ideal or unquantized high band spectrum could have almost the same energy level as the low band excitation spectrum. In practice, however, the synthesized or quantized high band spectrum may have the same or slightly higher energy level than the synthesized or quantized low band spectrum for two reasons. First the closed-loop CELP coding emphasizes provides a higher emphases on the higher energy area. Second, although the waveform matching for the low band signal is easier than for the high band signal, it is often difficult to have a good waveform matching for noise-like signals. The synthesized or quantized high band spectrum still has a fluctuating energy level over time due to its noise-like characteristics, depending on the quality of the waveform matching.

Figure 14:
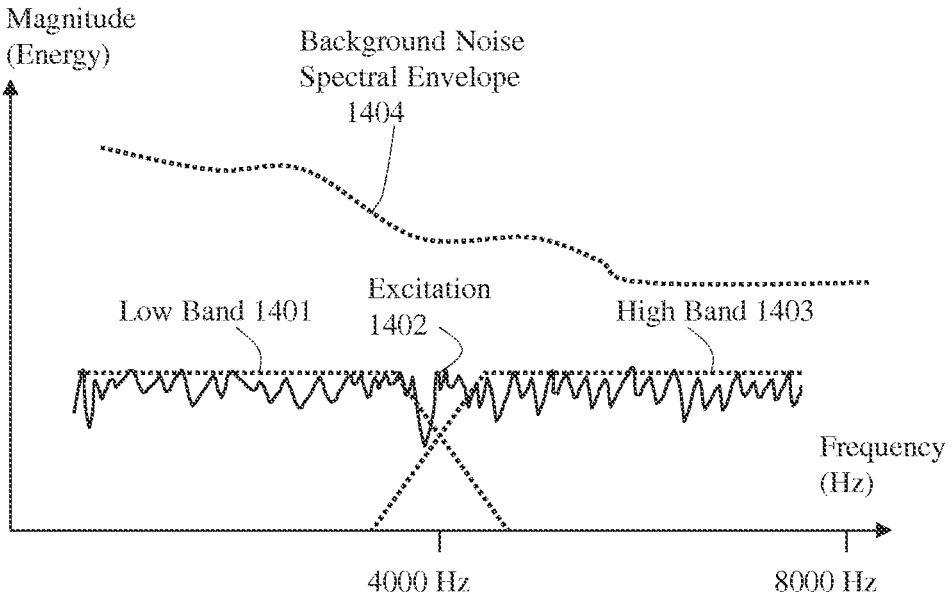
FIG. 14 illustrates an excitation spectrum for background noise.

FIG. 14 illustrates an example of excitation spectrum for background noise signal. Trace 1402 represents an excitation spectrum that is almost flat after removing the LPC spectral envelope 1404. Trace 1401 represents a low band excitation spectrum that is usually noise-like similar to high band spectrum 1403. Theoretically, the ideal or unquantized high band spectrum could have almost the same energy level as the low band excitation spectrum. In practice, however, the synthesized or quantized high band spectrum may have a lower energy level than the synthesized or quantized low band spectrum for two reasons. First closed-loop CELP coding provides a higher emphasis the low band, which has higher energy than the high band. Second, the waveform matching for the low band signal is easier to achieve than for the high band signal. Consequently, the synthesized or quantized high band spectrum has a higher fluctuation of its energy level over time than the synthesized or quantized low band spectrum, depending on the quality of the waveform matching.

Figure 15:
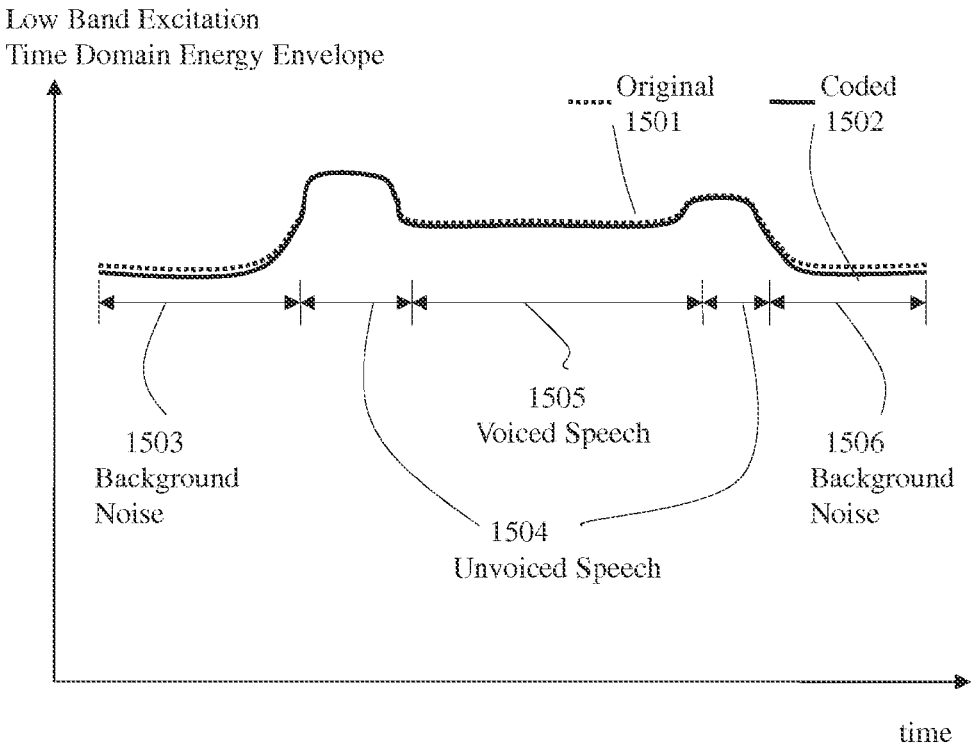
FIG. 15 illustrates a low band excitation time domain energy envelope.

FIG. 15 illustrates an example of an energy envelope over time for a low band excitation. Dashed line 1501 represents the energy envelope of the unquantized low band excitation. In addition, solid line 1502 represents the energy envelope of the quantized low band excitation, which is slightly lower than the unquantized low band excitation. The energy envelope of the quantized low band excitation, however, appears stable. Trace 1503 represents the background noise area, trace 1504 indicates the unvoiced area, and trace 1505 indicates the voiced area. In some embodiments, the energy level of the background noise area is nominally lower than the speech signal area. The energy level of the voiced speech area may be lower than the unvoiced speech area, because the LPC gain for removing the spectral envelope of voiced speech signal may be much higher than the unvoiced speech signal.

Figure 16:
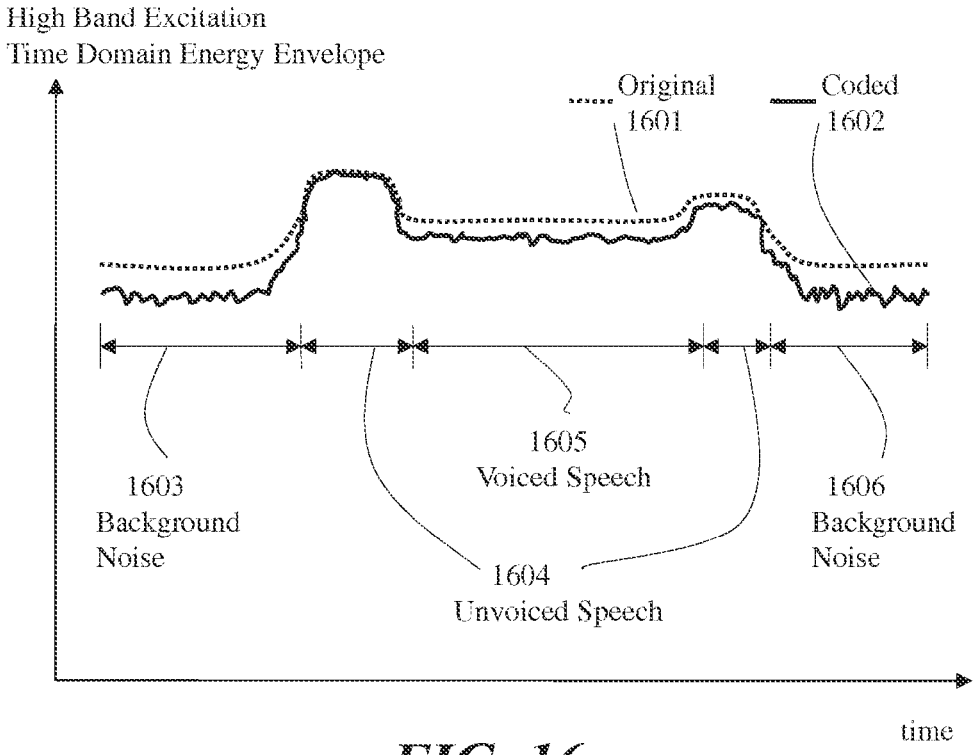
FIG. 16 illustrates a high band excitation time domain energy envelope.

FIG. 16 illustrates an example energy envelope over time for a high band excitation. Dashed line 1601 represents the energy envelope of the unquantized high band excitation, and solid line 1602 represents the energy envelope of the quantized high band excitation, which is normally lower than the one of the unquantized high band excitation the energy envelope of the quantized high band excitation, but is not stable. Trace 1603 represents the background noise area, trace 1604 represents the unvoiced area, and trace 1605 indicates the voiced area. The energy level of the background noise area is nominally lower than the speech signal area, and the energy level of the voiced speech area may be lower than the unvoiced speech area. This is because the LPC gain for removing the spectral envelope of voiced speech signal may be much higher than the unvoiced speech signal.

As such, the energy envelope of the quantized high band excitation at low quantization bit rates is not stable and it is often lower than the energy envelope of the unquantized high band excitation, especially for noisy input signals. Therefore, in some embodiments of the present invention, post enhancement of the quantized high band excitation may be performed without spending extra bits. In some embodiments, enhancement is not applied to the low band excitation because low band already has better waveform matching than the high band, and because the low band is much more sensitive than the high band for mis-modification of the post enhancement. Since the waveform matching of the high band signal is already bad for low bit rates, post enhancement of the quantized high band excitation may yield improvement of the perceptual quality, especially for noisy speech signals and background noise signals.

Figure 17:
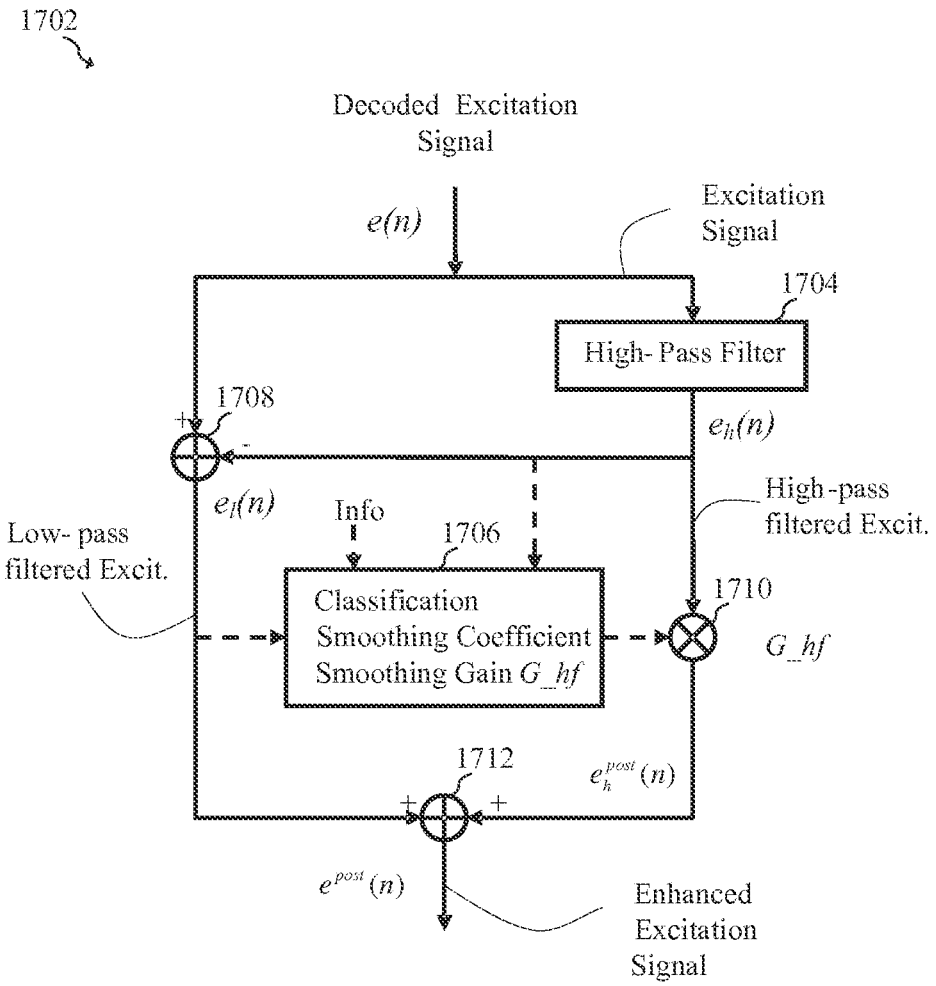
FIG. 17 illustrates a flow chart of an embodiment method.

FIG. 17 illustrates an embodiment post excitation enhancement processing block 1702 for low bit rates speech coding that generates enhanced excitation signal $e^{post}(n)$ from decided excitation signal e(n). In an embodiment, post excitation enhancement processing block 1702 divides decoded excitation signal e(n) into high frequency portion $e_h(n)$ and low frequency portion $e_l(n)$, calculates a high frequency gain using classification block 1706, and applied the calculated high frequency gain via multiplication block 1710. Summing block 1712 sums $e_h^{post}(n)$ and $e_l(n)$ together to form enhanced excitation signal $e^{post}(n)$ as described below.

Suppose the low pass filter $H_l(z)$ and the high pass filter $H_h(z)$ are symmetric each other, which satisfy $$H_l(z)=1-H_h(z). \tag{5}$$

In some embodiments, the following simple filters may be used:

$$H_h(z)=0.5-0.5z^{-1} \tag{6}$$

$$H_l(z)=0.5+0.5z^{-1}. \tag{7}$$

By using coefficients of 0.5, multiplication of filter coefficients may be implanted by simply right-shifting a digital representation of the signal by one bit. In alternative embodiments of the present invention, other filter types using different filter coefficients and other transfer functions may also be implemented. For example, higher order transfer functions and/or other IIR or FIR filter types may be used.

In some embodiments, low pass excitation signal $e_l(n)$ and high pass excitation signal $e_h(n)$ may both be derived using single high pass filter block 1704 to implement $H_h(z)$ and subtracting high pass portion $e_h(n)$ from decoded excitation signal e(n) to form $e_l(n)$. Therefore, the low pass filtered excitation $e_l(n)$ may be expressed as:

$$e_l(n)=e(n)-e_h(n). \tag{8}$$

It should be understood that in alternative embodiments, two separate filters, for example a separate low pass filter and a separate high pass filter, may also be used, as well as other filter structures.

With the high pass filtered excitation $e_h(n)$ and the low pass filtered excitation $e_l(n)$, corresponding energies may be calculated as follows:

$$\text{Energy_hf} = \sum_n e_h(n)^2 \tag{9}$$

$$\text{Energy_lf} = \sum_n e_l(n)^2 \tag{10}$$

In embodiments, the post excitation enhancement adaptively smooths the energy level of the quantized high band excitation, thereby making the energy level of the quantized high band excitation closer to the energy level of the unquantized high band excitation. This energy smoothing may be realized by multiplying an adaptive gain G_hf to the high pass filtered excitation $e_h(n)$ to get a scaled high band excitation signal:

$$e_h^{post}(n)=G_hf \cdot e_h(n). \tag{11}$$

The gain G_hf is estimated by using the following formula and updated according to a subframe basis:

$$\text{G_hf} = \sqrt{\frac{\text{Energy_Stable}}{\text{Energy_hf}}}. \tag{12}$$

In the above equation, Energy_Stable is a target energy level that can be estimated by smoothing the energies of the quantized high band or low band excitations using the following algorithm:

```
if (Energy_lf > Energy_hf),                                    (13)
   Energy_Stable = α · Energy_hf_old + (1−α) · g_hf · Energy_lf
else
   Energy_Stable = α · Energy_hf_old + (1−α) · g_hf · Energy_hf .
```

In the above expression, Energy_hf_old is the old or previous high band excitation energy obtained after the post enhancement is applied. Smoothing factor $\alpha$ ($0 \le \alpha < 1$) and scaling factor $g_{hf}$ ($g_{hf} \ge 1$) are adaptive to the signal or excitation class.

In one embodiment example, smoothing factor $\alpha$ in equation (13) may be determined as follows:

```
if (Stable_flag is true),                                      (14)
   α = 0.9 ;
else
   α = 0.75 Stab_fac · (1−Voic_fac) ; 0≤Voic_fac≤1,
```

where Stable_flag is a classification flag that identifies a stable excitation area or a stable signal area. In some embodiments, Stable_flag is updated for every 20 ms frame. Stab_fac ($0 \le$ Stab_fac $\le 1$) is a parameter that measures the stability of the LPC spectral envelope. For example, Stab_fac=1 means LPC is very stable and Stab_fac=0 means LPC is very unstable. Voic_fac ($-1 \le$ Voic_fac $\le 1$) is a parameter that measures the periodicity of voiced speech signal. For example Voic_fac=1 indicates a purely periodic signal. In equation (14), Voic_fac is limited to a value larger than zero. In some embodiments, Stab_fac and Voic_fac may be available at the decoder.

In one example, the classification decision of Stable_flag may be detected as follows:

```
Initial: Stable_flag = FALSE
if ( (Voic_fac < 0) and (Stab_fac > 0.7) and (VOICED is not true) )
{
```

-continued

```
   if ( (Energy_hf < 4 hf_energy_sm) and
      (Energy_hf < 4 hf_energy_old) and
      (Energy_hf > hf_energy_old / 4) )
   {
      Stable_flag = TRUE
   }
   if ( (Stab_fac > 0.95) and
      (Stab_fac_old > 0.9) )
   {
      Stable_flag = TRUE
   }
}.
```

It should be understood that the above algorithm is just one of the many embodiment algorithms that may be used to determine Stable_flag. In the above expressions, hf_energy_sm updated for each frame represents a smoothed background energy of energy_hf. hf_energy_old updated for each frame represents the old energy_hf.

In one embodiment for example, hf_energy_sm can be calculated as follows:

```
if ( hf_energy_sm > Energy_hf )
   hf_energy_sm ⇐ 0.75 hf_energy_sm + 0.25 Energy_hf
else
   hf_energy_sm ⇐ 0.999 hf_energy_sm + 0.001 Energy_hf .
```

In one embodiment, scaling factor $g_{hf}$ in equation (13) may be determined as follows:

```
Initial : g_hf = 1
if ( Noisy Excitation is true )
{
   g_hf = 1.5
   Unvoiced_flag = ( (Tilt_flag > 0) and (Voic_fac < 0) and
            (Energy_hf > 2 hf_energy_sm) )
         or
         ( (Tilt_flag > 0) and (Voic_fac < 0.1) and
            (Energy_hf > 8 hf_energy_sm) ) ;
   if (Unvoiced_flag is true)
   {
      g_hf = 4
   }
}
```

In the above expression, (Tilt_flag>0) means that the high band energy of the speech signal is higher than the low band energy of the speech signal.

In equations (11) and (12), final gain G_hf may be limited to a certain range, for example:

```
if ( (Stable _ flag is false) and (Unvoiced _ flag is false) )
{
   if (G_hf < 0.5) G_hf = 0.5 ;
   if (G_hf > 1.5) G_hf = 1.5 ;
}
else
{
   if (G_hf < 0.3) G_hf = 0.3 ;
   if (G_hf > 2) G_hf = 2 ;
}.
```

Once final gain G_hf in (11) is determined, the following post-enhanced excitation is obtained:

$$e_{post}(n) = e_l(n) + e_h^{post}(n) = e_l(n) + \text{G_hf} \cdot e_h(n). \quad (15)$$

In some embodiments, $e^{post}(n)$ may replace the synthesized excitation e(n) for noisy signals and for stable signals.

In some embodiments, listening test results show that the perceptual quality of noisy speech signal or stable signal is clearly improved by using the proposed post excitation enhancement, which sounds more smoother, more natural and less spiky.

Figure 18:
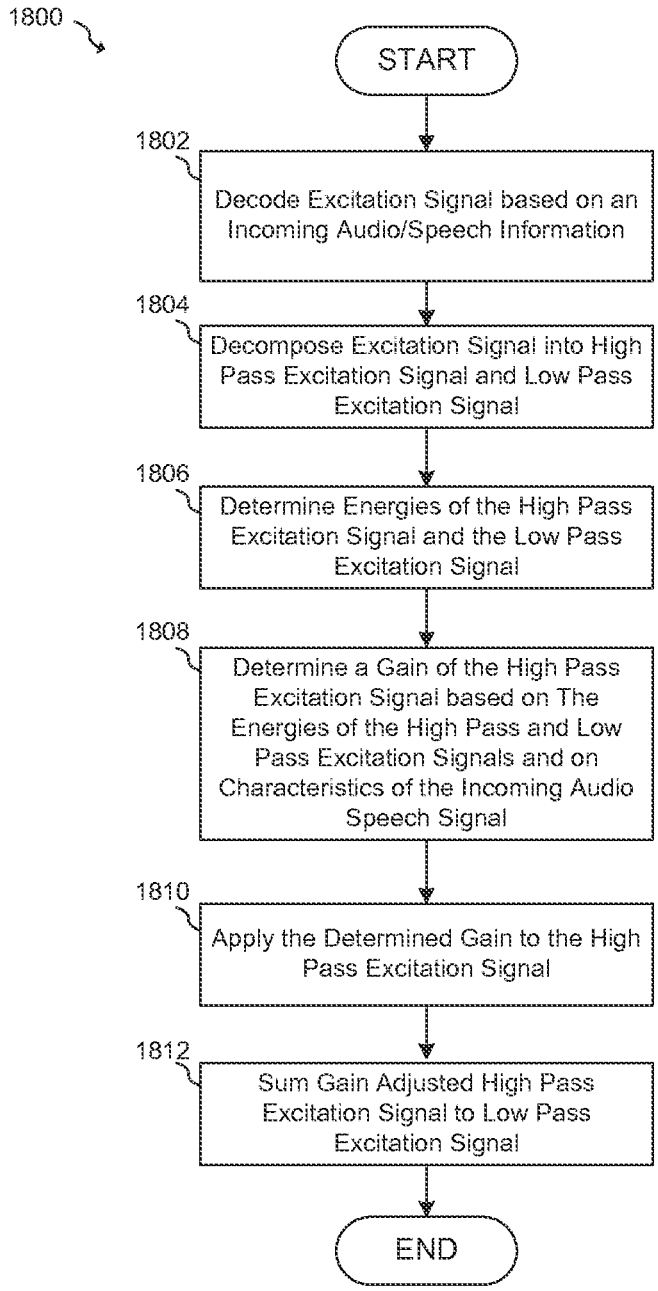
FIG. 18 illustrates an embodiment communication system.

FIG. 18 illustrates embodiment 1800 for performing a post excitation enhancement for low bit rate speech coding. In step 1802, an excitation signal is decoded based on an incoming audio/speech information. This excitation signal may be generated, using fixed and/or adaptive codebooks generating noise-like vectors, pulse-like vectors, or a combination thereof, as described in embodiments above. In step 1804, the excitation signal is decomposed into a high pass excitation signal and a low pass excitation signal. In one embodiment, the high pass excitation signal may be generated by high pass filtering the excitation signal, and the low pass excitation signal may be generated by subtracting the high pass excitation signal from the excitation signal. Alternatively, other filtering techniques may be used.

In step 1806, the energies of the high pass and low pass excitation signals are determined, and in step 1808, a gain of the high pass excitation signal is determined based on these determined energies. The gain of the high pass excitation signal may be determined in accordance with one or more of the above-described embodiments. In step 1810, the determined gain is applied to the high pass excitation signal, and in step 1812, the gained high pass excitation signal is summed with the low pass excitation signal to form an enhanced excitation signal.

Figure 19:
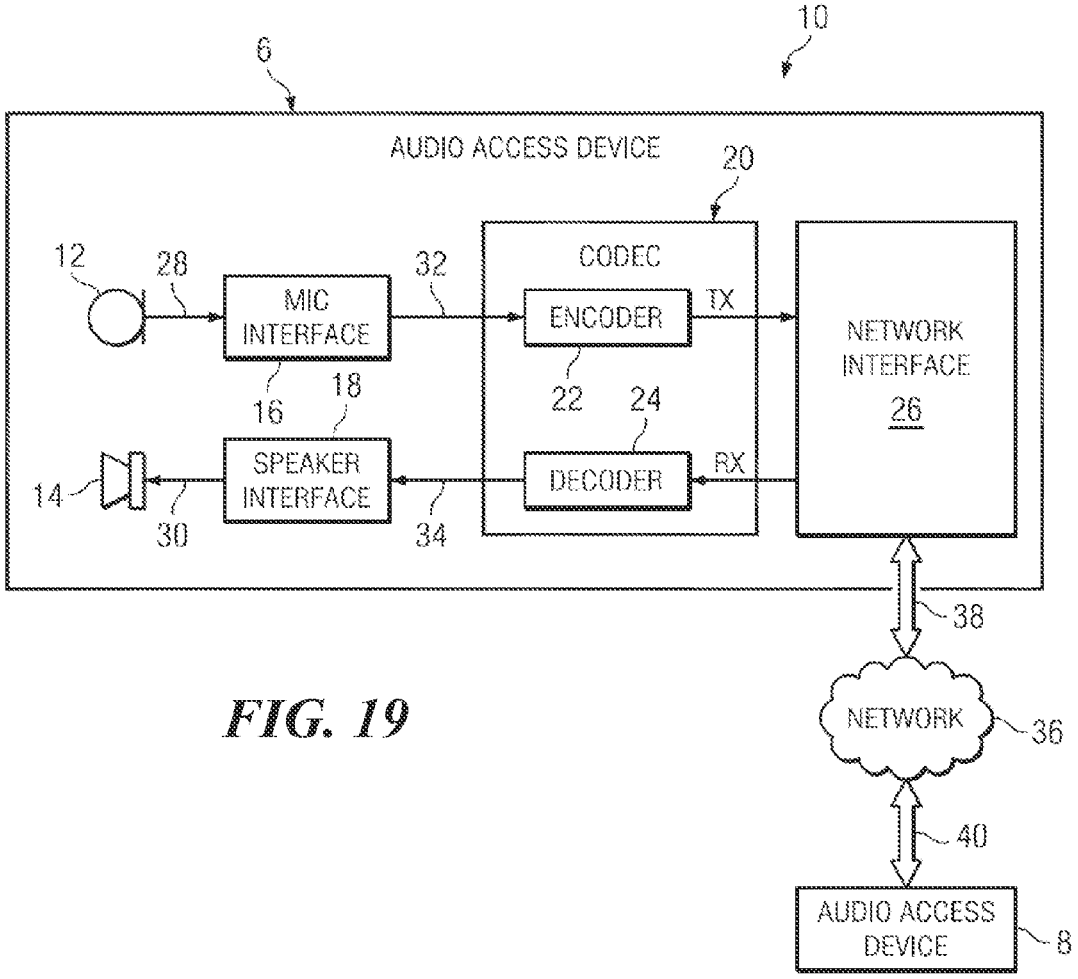
FIG. 19 illustrates an embodiment communication system.

FIG. 19 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VoIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In embodiments of the present invention, where audio access device 6 is a VoIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). An example of an embodiment computer program that may be run on a processor is listed in the Appendix of this disclosure and is incorporated by reference herein.

Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

In accordance with an embodiment, a method of decoding an audio/speech signal includes decoding an excitation signal based on an incoming audio/speech information, determining a stability of a high frequency portion of the excitation signal, smoothing an energy of the high frequency portion of the excitation signal based on the stability of the high frequency portion of the excitation signal, and producing an audio signal based on smoothing the high frequency portion of the excitation signal. Smoothing the energy of the high frequency portion of the excitation signal includes applying a smoothing function to the high frequency portion of the excitation signal. In some embodiments, the smoothing function may be stronger for high frequency portions of the excitation signal having a higher stability than for high frequency portions of the excitation signal having a lower stability. The steps of decoding the excitation signal, determining the stability and smoothing the high frequency portion of the excitation signal may be implemented using a hardware-based audio decoder. The hardware-based audio decoder may be implemented using a processor and/or dedicated hardware.

In an embodiment, determining the stability of the high frequency portion includes determining whether an energy of the high frequency portion of the excitation signal is between an upper bound and a lower bound. The upper bound and the lower bound are based on a smoothed high frequency energy and/or a previous high frequency energy, and the high frequency portion is determined to have a higher stability when the energy of the high frequency portion of the excitation signal is between the upper bound and the lower bound.

The method may further include determining a periodicity of the incoming audio/speech signal, and increasing a strength of the smoothing function inversely proportional to the determined periodicity of the incoming audio/speech signal constitutes voiced speech. Furthermore, determining the stability of a high frequency portion of the excitation signal may include evaluating linear prediction coefficient (LPC) stability of a synthesis filter.

In an embodiment, smoothing the high frequency portion of the excitation signal includes determining a high frequency gain and applying the high frequency gain to high frequency portion of the excitation signal. Determining this high frequency gain may include determining the following expression:

$$G_hf = \sqrt{\frac{Energy_Stable}{Energy_hf}},$$

where G_hf is the high frequency gain, Energy_Stable is a target high frequency energy level, and Energy_hf is an energy of the high frequency portion of the excitation signal. In some embodiments, the method further comprises determining the target high frequency energy level by calculating:

$$Energy_Stable = \alpha \cdot Energy_hf_old + (1-\alpha) \cdot g_{hf} \cdot Energy_lf,$$

when the energy of a low frequency portion of the excitation signal is greater than the energy of the high frequency portion of the excitation signal. Energy_Stable is the target high frequency energy level, Energy_lf is the energy of the low frequency portion of the excitation signal, Energy_lf_old is a previous high band excitation energy obtained after post enhancement is applied, $\alpha$ is a smoothing factor, and $g_{hf}$ is a scaling factor. The method further includes calculating $$Energy_Stable = \alpha \cdot Energy_hf_old + (1-\alpha) \cdot g_{hf} \cdot Energy_hf,$$

when the energy of a low frequency portion of the excitation signal is not greater than the energy of high frequency portion of the excitation signal, where Energy_hf is the energy of the high frequency portion of the excitation signal. In some embodiments, scaling factor $g_{hf}$ is higher for noisy excitation and unvoiced speech than it is for voiced speech.

In accordance with a further embodiment, a method of decoding an audio/speech signal includes generating an excitation signal based on an incoming audio/speech information, decomposing the generated excitation signal into a high pass excitation signal and a low pass excitation signal and calculating a high frequency gain. Calculating the high frequency gain includes calculating an energy of the high pass excitation signal, calculating an energy of the low pass excitation signal, and determining the high frequency gain based on the calculated energy of the high pass excitation signal and based on the calculated energy of the low pass excitation signal. The method further includes applying the high frequency gain to the high pass excitation signal to form a modified high pass excitation signal, and summing the low pass excitation signal to the modified high pass excitation signal to form an enhanced excitation signal. An audio signal is generated based on the enhanced excitation signal. In an embodiment, determining and generating are performed using a hardware-based audio decoder that may be implemented, for example, using a processor and/or dedicated hardware.

In an embodiment, determining the high frequency gain includes determining a target high frequency energy level, and determining the high frequency gain based on the target high frequency energy level. Determining the high frequency gain based on the target high frequency energy level may include evaluating the following expression:

$$G_hf = \sqrt{\frac{Energy_Stable}{Energy_hf}},$$

where G_hf is the high frequency gain, Energy_Stable is the target high frequency energy level, and Energy_hf is the calculated energy of the high pass excitation signal.

In some embodiments, determining the target high frequency energy level includes determining whether the calculated energy of the low pass excitation signal is greater than the calculated energy of the high pass excitation signal, determining the target high frequency energy level by smoothing energies of the calculated energy of the low pass excitation signal when the calculated energy of the low pass excitation signal is greater than the calculated energy of the high pass excitation signal, and determining the target high frequency energy level by smoothing energies of the calculated energy of the high pass excitation signal when the calculated energy of the low pass excitation signal is not greater than the calculated energy of the high pass excitation signal.

Smoothing the energies of the calculated energy of the low pass excitation signal may include determining the following expression:

$$Energy_Stable = \alpha \cdot Energy_hf_old + (1-\alpha) \cdot g_{hf} \cdot Energy_lf,$$

where Energy_Stable is the target high frequency energy level, Energy_lf is the calculated energy of the low pass excitation signal, Energy_hf_old is a previous high band excitation energy obtained after post enhancement is applied, $\alpha$ is a smoothing factor, and $g_{hf}$ is a scaling factor. Smoothing the energy of the high pass excitation signal may include determining:

$$Energy_Stable = \alpha \cdot Energy_hf_old + (1-\alpha) \cdot g_{hf} \cdot Energy_hf,$$

where Energy_hf is the calculated energy of the high pass excitation signal.

In an embodiment, the method further includes classifying the incoming audio/speech signal, and determining a smoothing factor based on the classifying, such that smoothing the energies of the calculated energy of the high pass excitation signal includes applying the smoothing factor. Classifying the incoming audio/speech signal may include determining whether the incoming audio/speech signal is operating in a stable excitation area, and determining the smoothing factor includes determining the smoothing factor to be a higher smoothing factor when the incoming audio/speech signal is operating in a stable excitation area than when the incoming audio/speech signal is not operating in a stable excitation area. In further embodiments, determining the smoothing factor includes determining the smoothing factor to be inversely proportional to a periodicity of the incoming audio/speech signal.

In an embodiment, determining whether the incoming audio/speech signal is operating is a stable excitation area includes determining whether the calculated energy of the high pass excitation signal is within an upper bound and a lower band. The upper bound and the lower bound are based on a smoothed calculated energy of the high pass excitation signal, and/or a previous calculated energy of the high pass excitation signal.

In accordance with a further embodiment, a system for decoding an audio speech signal includes a hardware-based audio decoder having an excitation generator, a filter and a gain calculator. The excitation generator is configured to generate an excitation signal based on an incoming audio/speech information, and the filter has an input coupled to an output of the excitation generator and is configured to output a high pass excitation signal and a low pass excitation signal. The gain calculator is configured to determine a smoothing gain factor of the high pass excitation signal based on energies of the high pass excitation signal and of the low pass excitation signal, and apply the determined gain to the high pass excitation signal. In an embodiment, the gain calculator is further configured to calculate the energies of the high pass excitation signal and the low pass excitation signal. The hardware-based audio decoder may be implemented, for example, using a processor and/or dedicated hardware.

In an embodiment, the gain calculator is further configured to determine a stability of the high pass excitation signal by determining whether the energy of the high pass excitation signal is between an upper bound and a lower bound, such that the upper bound and the low bound are based on a smoothed energy of the high pass excitation signal and/or a previous energy of the high pass excitation signal, and the high pass excitation signal is determined to have a higher stability when the energy of the high pass excitation signal is between the upper bound and the lower bound. The gain calculator may determine the smoothing gain factor according to the following expression:

$$G_hf = \sqrt{\frac{Energy_Stable}{Energy_hf}},$$

where G_hf is the smoothing gain factor, Energy_Stable is a target high frequency energy level, and Energy_hf is an energy of the high pass excitation signal.

In some embodiments, the method further includes determining the target high frequency energy level by calculating $$Energy_Stable = \alpha \cdot Energy_hf_old + (1-\alpha) \cdot g_{hf} \cdot Energy_lf,$$

when the energy of the low pass excitation signal is greater than the energy of the high pass excitation signal. Energy_Stable is the target high frequency energy level, Energy_lf is the energy of the low pass excitation signal, Energy_hf_old is a previous high band excitation energy obtained after post enhancement is applied, $\alpha$ is a smoothing factor, and $g_{hf}$ is a scaling factor. When the energy of the low pass excitation signal is not greater than the energy of the high pass excitation signal, Energy_Stable is calculated as follows:

$$Energy_Stable = \alpha \cdot Energy_hf_old + (1-\alpha) \cdot g_{hf} \cdot Energy_hf,$$

where Energy_hf is the energy of the high pass excitation signal.

An advantage of embodiment systems and methods include enhancing sound quality when using low bit-rate speech coding. In particular, artifacts that occur as a result of low-bit rate coding in the high band, such as clicks, pops or spiky sounds in the audio signal during portions of relative stability in the high band, are attenuated and/or eliminated.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of decoding an audio/speech signal, the method comprising:

decoding an excitation signal based on an incoming audio/speech information;

determining a stability of a high frequency portion of the excitation signal;

smoothing an energy of the high frequency portion of the excitation signal based on the stability of the high frequency portion of the excitation signal, wherein smoothing the energy of the high frequency portion of the excitation signal comprises applying a smoothing function to the high frequency portion of the excitation signal, the smoothing function is stronger for high frequency portions of the excitation signal having a higher stability than for high frequency portions of the excitation signal having a lower stability; and producing an audio signal based on smoothing the high frequency portion of the excitation signal, wherein the steps of decoding the excitation signal, determining the stability and smoothing the high frequency portion of the excitation signal comprises using a hardware-based audio decoder.

2. The method of claim 1, wherein determining the stability of the high frequency portion comprises determining whether an energy of the high frequency portion of the excitation signal is between an upper bound and a lower bound, wherein the upper bound and the lower bound are based on a smoothed high frequency energy and/or a previous high frequency energy;

and the high frequency portion is determined to have a higher stability when the energy of the high frequency portion of the excitation signal is between the upper bound and the lower bound.

3. The method of claim 1, further comprising determining a periodicity of the incoming audio/speech signal, and increasing a strength of the smoothing function inversely proportional to the determined periodicity of the incoming audio/speech signal constitutes voiced speech.

4. The method of claim 1, wherein determining the stability of a high frequency portion of the excitation signal comprises evaluating linear prediction coefficient (LPC) stability of a synthesis filter.

5. The method of claim 1, wherein smoothing the high frequency portion of the excitation signal comprising determining a high frequency gain and applying the high frequency gain to high frequency portion of the excitation signal.

6. The method of claim 5, wherein determining the high frequency gain comprises determining the following expression:

$$G_hf = \sqrt{\frac{Energy_Stable}{Energy_hf}},$$

where G_hf is the high frequency gain, Energy_Stable is a target high frequency energy level, and Energy_hf is an energy of the high frequency portion of the excitation signal.

7. The method of claim 6, further comprising determining the target high frequency energy level comprising calculating $$Energy_Stable = \alpha \cdot Energy_hf_old + (1-\alpha) \cdot g_{hf} \cdot Energy_lf,$$

when the energy of a low frequency portion of the excitation signal is greater than the energy of the high frequency portion of the excitation signal, wherein Energy_Stable is the target high frequency energy level, Energy_lf is the energy of the low frequency portion of the excitation signal, Energy_lf_old is a previous high band excitation energy obtained after post enhancement is applied, $\alpha$ is a smoothing factor, and $g_{hf}$ is a scaling factor; and calculating $$\text{Energy_Stable}=\alpha\cdot\text{Energy_}hf\text{_old}+(1-\alpha)\cdot g_{hf}\cdot\text{Energy_}hf,$$

when the energy of a low frequency portion of the excitation signal is not greater than the energy of high frequency portion of the excitation signal, where Energy_hf is the energy of the high frequency portion of the excitation signal.

8. The method of claim 7, wherein the scaling factor $g_{hf}$ is higher for noisy excitation and unvoiced speech than it is for voiced speech.

9. The method of claim 1, wherein the hardware-based audio decoder comprises a processor.

10. The method of claim 1, wherein the hardware-based audio decoder comprises dedicated hardware.

11. A method of decoding an audio/speech signal, the method comprising:

generating an excitation signal based on an incoming audio/speech information;

decomposing the generated excitation signal into a high pass excitation signal and a low pass excitation signal;

calculating a high frequency gain comprising:

calculating an energy of the high pass excitation signal;

calculating an energy of the low pass excitation signal;

determining the high frequency gain based on the calculated energy of the high pass excitation signal and based on the calculated energy of the low pass excitation signal;

applying the high frequency gain to the high pass excitation signal to form a modified high pass excitation signal; and summing the low pass excitation signal to the modified high pass excitation signal to form an enhanced excitation signal; and generating an audio signal based on the enhanced excitation signal, wherein the determining and generating are performed using a hardware-based audio decoder.

12. The method of claim 11, wherein determining the high frequency gain comprises:

determining a target high frequency energy level; and determining the high frequency gain based on the target high frequency energy level.

13. The method of claim 12, wherein determining the high frequency gain based on the target high frequency energy level comprises determining the following expression:

$$\text{G_hf}=\sqrt{\frac{\text{Energy_Stable}}{\text{Energy_hf}}},$$

where G_hf is the high frequency gain, Energy_Stable is the target high frequency energy level, and Energy_hf is the calculated energy of the high pass excitation signal.

14. The method of claim 12, wherein determining the target high frequency energy level comprises:

determining whether the calculated energy of the low pass excitation signal is greater than the calculated energy of the high pass excitation signal;

determining the target high frequency energy level by smoothing energies of the calculated energy of the low pass excitation signal when the calculated energy of the low pass excitation signal is greater than the calculated energy of the high pass excitation signal; and determining the target high frequency energy level by smoothing energies of the calculated energy of the high pass excitation signal when the calculated energy of the low pass excitation signal is not greater than the calculated energy of the high pass excitation signal.

15. The method of claim 14, wherein:

the smoothing the energies of the calculated energy of the low pass excitation signal comprises determining $$\text{Energy_Stable}=\alpha\cdot\text{Energy_}hf\text{_old}+(1-\alpha)\cdot g_{hf}\cdot\text{Energy_}lf,$$

wherein Energy_Stable is the target high frequency energy level, and Energy_lf is the calculated energy of the low pass excitation signal, Energy_hf_old is a previous high band excitation energy obtained after post enhancement is applied, $\alpha$ is a smoothing factor, and $g_{hf}$ is a scaling factor; and smoothing the energy of the high pass excitation signal comprises determining $$\text{Energy_Stable}=\alpha\cdot\text{Energy_}hf\text{_old}+(1-\alpha)\cdot g_{hf}\cdot\text{Energy_}hf,$$

where Energy_hf is the calculated energy of the high pass excitation signal.

16. The method of claim 14, further comprising;

classifying the incoming audio/speech signal; and determining a smoothing factor based on the classifying, wherein the smoothing the energies of the calculated energy of the high pass excitation signal comprises applying the smoothing factor.

17. The method of claim 16, wherein classifying the incoming audio/speech signal comprises determining whether the incoming audio/speech signal is operating in a stable excitation area, and determining the smoothing factor comprises determining the smoothing factor to be a higher smoothing factor when the incoming audio/speech signal is operating in a stable excitation area than when the incoming audio/speech signal is not operating in a stable excitation area.

18. The method of claim 17, wherein determining whether the incoming audio/speech signal is operating is a stable excitation area comprises determining whether the calculated energy of the high pass excitation signal is within an upper bound and a lower band, wherein the upper bound and the lower bound are based on a smoothed calculated energy of the high pass excitation signal, and/or a previous calculated energy of the high pass excitation signal.

19. The method of claim 16, wherein determining the smoothing factor comprises determining the smoothing factor to be inversely proportional to a periodicity of the incoming audio/speech signal.

20. The method of claim 11, wherein the hardware-based audio decoder comprises a processor.

21. The method of claim 11, wherein the hardware-based audio decoder comprises dedicated hardware.

22. A system for decoding an audio speech signal, the system comprising:

a hardware-based audio decoder comprising:

an excitation generator configured to generate an excitation signal based on an incoming audio/speech information;

a filter having an input coupled to an output of the excitation generator, the filter configured to output a high pass excitation signal and a low pass excitation signal; and a gain calculator configured to determine a smoothing gain factor of the high pass excitation signal based on energies of the high pass excitation signal and of the low pass excitation signal; and a multiplier configured to apply the determined gain to the high pass excitation signal to form a modified high pass excitation signal.

23. The system of claim 22, wherein the gain calculator is further configured to calculate the energies of the high pass excitation signal and the low pass excitation signal.

24. The system of claim 22, wherein the gain calculator is further configured to determine a stability of the high pass excitation signal by determining whether the energy of the high pass excitation signal is between an upper bound and a lower bound, wherein the upper bound and the low bound are based on a smoothed energy of the high pass excitation signal and/or a previous energy of the high pass excitation signal; and the high pass excitation signal is determined to have a higher stability when the energy of the high pass excitation signal is between the upper bound and the lower bound.

25. The system of claim 22, wherein the gain calculator determines the smoothing gain factor according to the following expression:

$$G_hf = \sqrt{\frac{Energy_Stable}{Energy_hf}},$$

where G_hf is the smoothing gain factor, Energy_Stable is a target high frequency energy level, and Energy_hf is an energy of the high pass excitation signal.

26. The system of claim 25, further comprising determining the target high frequency energy level comprising calculating $$Energy_Stable = \alpha \cdot Energy_hf_old + (1-\alpha) \cdot g_{hf} \cdot Energy_lf,$$

when the energy of the low pass excitation signal is greater than the energy of the high pass excitation signal, wherein Energy_Stable is the target high frequency energy level, and Energy_lf is the energy of the low pass excitation signal, Energy_hf_old is a previous high band excitation energy obtained after post enhancement is applied, $\alpha$ is a smoothing factor, and $g_{hf}$ is a scaling factor; and calculating $$Energy_Stable = \alpha \cdot Energy_hf_old + (1-\alpha) \cdot g_{hf} \cdot Energy_hf,$$

when the energy of the low pass excitation signal is not greater than the energy of the high pass excitation signal, where Energy_hf is the energy of the high pass excitation signal.

27. The system of claim 22, wherein the hardware-based audio decoder comprises a processor.

28. The system of claim 22, wherein the hardware-based audio decoder comprises dedicated hardware.

29. The system of claim 22, wherein the hardware-based audio decoder further comprises a summer configured to sum the low pass excitation signal to the modified high pass excitation signal to form an enhanced excitation signal for generating the audio speech signal.

* * * * *